US005676812A

United States Patent [19]

Kadokura

[11] Patent Number: 5,676,812

[45] Date of Patent: *Oct. 14, 1997

[54] ELECTRONIC EQUIPMENT WITH AN ADHESIVE MEMBER TO INTERCEPT ELECTROMAGNETIC WAVES

[75] Inventor: Susumu Kadokura, Sagamihara, Japan

[73] Assignee: Canon Kabushiki Kaisha, Tokyo, Japan

[ * ] Notice: The term of this patent shall not extend beyond the expiration date of Pat. No. 5,170,009.

[21] Appl. No.: 90,647

[22] Filed: Jul. 13, 1993

Related U.S. Application Data

[63] Continuation of Ser. No. 674,145, Mar. 25, 1991, abandoned.

[30] Foreign Application Priority Data

| | | | |
|---|---|---|---|
| Mar. 24, 1990 | [JP] | Japan | 2-74204 |
| Mar. 26, 1990 | [JP] | Japan | 2-77496 |
| Mar. 26, 1990 | [JP] | Japan | 2-77497 |
| May 8, 1990 | [JP] | Japan | 2-119464 |

[51] Int. Cl.[6] ..... C25D 13/12

[52] U.S. Cl. ..... 205/50; 174/35 R; 174/35 MS; 361/816; 204/486

[58] Field of Search ..... 204/180.2, 180.9, 204/181.6, 181.7, 181.1, 486; 252/511, 512, 514; 174/35 R, 35 MS; 361/816; 205/50

[56] References Cited

U.S. PATENT DOCUMENTS

| | | | |
|---|---|---|---|
| 3,445,361 | 5/1969 | Sicks | 204/181 |
| 4,579,882 | 4/1986 | Kanbe et al. | 252/514 |
| 4,806,200 | 2/1989 | Larson et al. | 29/847 |
| 4,844,784 | 7/1989 | Suzuki et al. | 204/180.9 |
| 4,891,069 | 1/1990 | Holtzman et al. | 205/125 |
| 5,106,690 | 4/1992 | Stramel | 252/500 |
| 5,170,009 | 12/1992 | Kadokura | 174/35 R |

FOREIGN PATENT DOCUMENTS

| | | |
|---|---|---|
| 223763 | 12/1984 | Japan . |
| 61-276979 | 12/1986 | Japan . |

*Primary Examiner*—Kathryn L. Gorgos
*Assistant Examiner*—Kishor Mayekar
*Attorney, Agent, or Firm*—Fitzpatrick, Cella, Harper & Scinto

[57] ABSTRACT

An electroconductive adhesive member comprises a substrate and an adhesive resin layer containing electroconductive particles. The layer is formed on the substrate by electrodeposition coating.

5 Claims, 5 Drawing Sheets

ELECTRONIC EQUIPMENT WITH AN ADHESIVE MEMBER TO INTERCEPT ELECTROMAGNETIC WAVES

This application is a continuation of application Ser. No. 07/674,145 filed Mar. 25, 1991, now abandoned.

BACKGROUND OF THE INVENTION

1. Field of the Invention

This Invention relates to an electroconductive adhesive member for use in the shield of electromagnetic waves generated from optical equipment such as cameras, etc., audio equipment, such as compact disk players, etc., or computers, word processors, and measuring instruments, etc. and also to a process for preparing the electroconductive adhesive.

2. Related Background Art

Electromagnetic wave interceptability is required for outer covers of electronic equipment such as optical equipment (cameras, etc.), home electrical appliance, displays, computers, word processors, etc. and measuring instruments in order to prevent the leakage of electromagnetic waves generated from high frequency oscillation circuits, motors, and picture tubes, etc. set in the electronic equipment. For the recent compact and light-weight electronic equipment, plastic outer covers have been used and thus the interception of electromagnetic waves has been an important problem.

Heretofore, the electromagnetic wave interceptability of plastic covers has been provided by spray coating of electroconductive paints, zinc flame spraying, electroless copper plating, vacuum vapor deposition of aluminum, or by use of electroconductive plastics.

To reduce the weight and cost of plastic outer covers, an electroconductive adhesive member, a film coated with an adhesive in which metal particles such as nickel powder, etc. are dispersed, is attached to the inner surfaces of the covers to efficiently intercept the electromagnetic waves. Such electroconductive adhesive member is prepared by coating a metallic substrate or a metal-plated plastic film substrate with a special adhesive containing metallic particles of large particle size by using spray coating, dip coating, laminating, brush coating, knife coating, spin coating, far coating, roll coating or hot melt coating methods.

According to the above mentioned method in which relatively large metallic particles, for example, those having particle sizes of 10 μm or more, are used in the adhesive for an electroconductive adhesive layer, it is difficult to form an adhesive layer with a uniform electroconductivity owing to a separation phenomenon between the metallic particles and the adhesive material. In order to give a satisfactory intercepting effect to such adhesive layer, the thickness of the adhesive layer must be at least 50 μm, resulting in higher costs. When the content of the metallic particles is increased to improve the electroconductivity, lowering in the adhesiveness occurs.

Furthermore, the constant stirring of the adhesive is required to prevent occurrence of the separation phenomenon between the metallic particles and the adhesive, resulting in further problems in the manipulation of the adhesive. Still furthermore, with spray coating, it is difficult to make a uniform adhesive layer, and it is necessary in the dip coating to control the pull-up speed, viscosity of the adhesive, and to keep other conditions constant. Thus, it is difficult to obtain a uniform layer thickness, resulting in unevenness of electromagnetic wave interceptability.

When an electroconductive cover is formed by bonding two electroconductive case members with an electroconductive adhesive member, it is necessary to make electroconduction between the case members so as to prevent leakage of electromagnetic waves from the qlued regions of the case members. However, the conventional electroconductive adhesive member fails to satisfy such contradicting characteristics as maintenance of adhesiveness and improved electroconductivity at the same time. Therefore, when bonding the case members to one another using the conventional electroconductive adhesive member, it is necessary to use other electroconducting means such as washers and lead wires, or damping screws.

SUMMARY OF THE INVENTION

An object of the present invention is to overcome the above-mentioned problems and to provide an electroconductive adhesive member having a good adhesiveness and a distinguished interceptability against electromagnetic waves and also to provide a process for preparing the electroconductive adhesive.

Another object of the present invention is to provide an electroconductive cover having a distinguished electromagnetic wave intercepting effect, wherein the cover comprises at least two case members bonded together provided with a good electroconductivity at the contact surfaces of the case members.

That is, the present invention provides an electroconductive adhesive member, which comprises a substrate and at least one electroconductive resin layer containing electroconductive particles, wherein the layer is formed by electrodeposition coating.

Furthermore, the present invention provides a process for preparing an electroconductive adhesive member, which comprises dipping a substrate into an electrodeposition paint containing an electrodepositable adhesive resin and electroconductive particles, depositing the adhesive resin and the electroconductive particles onto the substrate by electrodeposition using the substrate as an electrode, and thereby forming an electroconductive adhesive resin layer on the substrate.

Still furthermore, the present invention provides an electroconductive cover, which comprises at least two case members bonded to one another edgeways by an electroconductive adhesive member and electrically conducted therebetween, the electroconductive adhesive member comprising a substrate and an adhesive resin layer containing electroconductive particles, formed on at least one side of the substrate by electrodeposition coating.

According to the present invention, the electroconductive adhesive resin layer is formed by depositing an adhesive resin and electroconductive particles on a substrate by electrodeposition coating, differing from the spray coating the electroconductive particles, and can be more densely and uniformly deposited on the substrate. Thus an electroconductive adhesive member can be obtained, even if the resin layer is a thin film, with good adhesiveness and less variation of the electromagnetic wave intercepting effect.

BRIEF DESCRIPTION OF THE DRAWINGS

FIG. 1A is a partial cross-sectional view of an outer cover and FIG. 1B is an enlarged cross-sectional view of the present electroconductive adhesive member.

FIG. 3A is directed to a non-metallic substrate and FIG. 3B is directed to a metallic substrate.

DETAILED DESCRIPTION OF THE PREFERRED EMBODIMENT

The present invention will be described in detail below, in reference to the drawings.

Figure 1A:
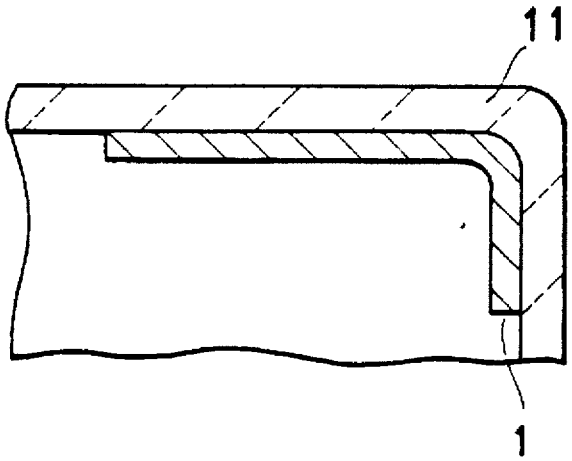
FIG. 1A and FIG. 1B are schematic views of an outer cover of an electronic equipment using the present electroconductive adhesive member, where
Figure 1B:
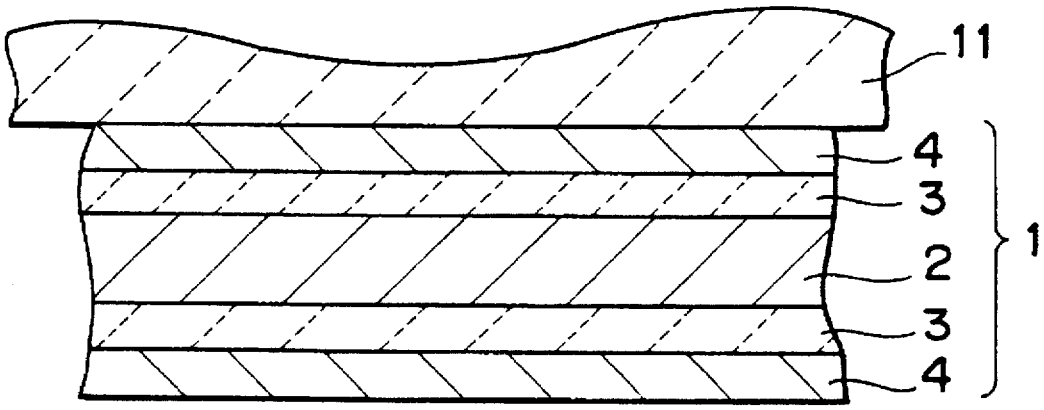

FIG. 1A is a schematic cross-sectional view of an outer cover 11 of an electronic equipment provided with an electromagnetic wave interception by the present electroconductive adhesive member 1. FIG. 1B is an enlarged partial cross-sectional view in part of the present electroconductive adhesive member 1.

As shown in FIG. 1A, the present invention provides an electroconductive adhesive member for use in the efficient interception of electromagnetic noises generated from electronic equipment by attaching the present electroconductive adhesive member on the inner surface of an outer cover 11 of electronic equipment, etc. FIG. 1B shows an enlarged partial cross-sectional view of the electroconductive adhesive member 1, where a thin metallic film layer 3 such as a thin copper film, etc. is formed on a non-metallic substrate 2, and then an electroconductive adhesive resin layer 4 is formed thereon by electrodeposition coating.

Figure 2:
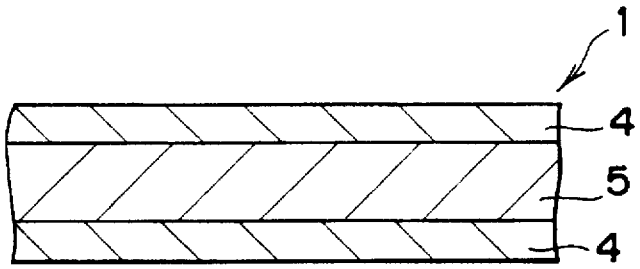
FIG. 2 is a cross-sectional view of another embodiment of the present electroconductive adhesive member.

FIG. 2 is a partial cross-sectional view of another embodiment of the present electroconductive adhesive member 1, where electroconductive adhesive resin layers 4 are formed on both sides of a metallic substrate 5 by electrodeposition coating.

In the present invention, the electroconductive adhesive resin layer 4 is formed by depositing an electrodepositable resin and electroconductive particles onto a substrate by electrodeposition coating, and the electroconductive particles are compactly and uniformly contained in the resin layer 4. Thus, the adhesive resin layer 4 has a good electromagnetic wave interceptability, even if the adhesive resin layer 4 is a thin film, and also has good adhesiveness because the high content of the electroconductive particles is not required as in the case of spray coating.

Electroconductive particles to be deposited together with the adhesive resin as the adhesive resin layer 4 (resin layer 4) in the present invention are not particularly specified, so long as the particles can give good electroconductivity. That is, the electroconductive particles comprise, for example, ceramic particles whose surfaces are plated with a metal (metal-plated ceramic powder), natural mica particles whose surfaces are plated with a metal (metal-plated natural mica powder), or their mixture, ultra fine metal powder having an average particle size of 0.01 to 5 μm, resin powder having a metallic coating on the surfaces of particles or their mixture, and furthermore a mixture of one or two members selected from the group consisting of metal-plated ceramic powder and metal-plated natural mica powder, and one or two members selected from the group consisting of ultra fine metal powder and metal-plated resin powder. Particularly when metal-plated ceramic powder or metal-plated natural mica powder is used as the electroconductive particles, the present electroconductive adhesive member can more firmly adhere to an adherend member such as an outer cover as shown in FIG. 1A, thereby an accident of dropoff of the electroconductive adhesive member after the assembling of electronic equipment can be prevented.

During the bonding step to an adherend member, the resin layer 4 is cured by cross-linking, and thus the necessary energy and/or time may be saved or shortened.

The reason why the resin layer 4 containing a metal-plated ceramic powder or a metal-plated natural mica powder or their mixture shows a strong adhesiveness is not clarified yet, but it seems that, different from metal powders with readily oxidizable surfaces, these powders can maintain the powder surfaces in an active state to some extent due to an interaction between the powder surfaces and the metal coating, and the active surfaces serve as cross-linking sites to promote the cross-linking of the adhesive resin.

In the present invention, metal-plated ceramic powder and metal-plated natural mica powder include ceramic powder and natural mica powder plated with Cu, Ni, Ag, Au, Sn, etc. on the surfaces. For the plating of the powder surfaces, it is preferable to use Cu, Ag or Ni from the viewpoint of wave interceptability and cost. As a plating method on the powder surfaces electroless plating is preferred. With the thickness of plating on the powder surfaces of 0.05 to 3 μm, particularly 0.15 to 2 μm, a good wave interceptability and good film physical properties can be obtained when cured at a low temperature. When the plating is thicker than 3 μm, the surface characteristics become similar to those of metal powder and the surfaces will be so active that they are oxidized in the air, resulting in decrease in the cross-linking sites and unsatisfactory cross-linking of the adhesive resin.

As disclosed in Japanese Patent Laid-Open Application No. 61-276979, nickel plating onto the powder surfaces can be carried out by preparing an aqueous suspension of powder, and adding an used electroless nickel plating solution to the suspension, thereby forming a nickel plating on the powder surface, which results in a nickel plating having a low phosphorus content not more than 5% by weight. Using such nickel-coated powder a resin layer 4 having an increased electroconductivity and an almost equal wave interceptability to that of Cu-plated powder can be obtained.

In view of the surface area contributable to the surface activity and dispersibility in the electrodeposition paint, the average particle size of ceramic powder and natural mica powder is 0.1 to 5 μm, preferably 0.15 to 3 μm, more preferably 0.5 to 2 μm.

"Ceramics" in the present invention means non-metallic, inorganic solid materials prepared by heat treatment, and includes, for example, aluminum oxide, titanium nitride, manganese nitride, tungsten nitride, tungsten carbide, lanthanum nitride, aluminum silicate, molybdenum disulfide, titanium oxide, silicic acid, etc., and natural mica in the present invention includes, for example, phlogopite mica, sericite mica, muscovite mica, etc.

As other electroconductive particles, ultra fine metal powders having an average particle size of 0.01 to 5 μm and metal-plated resin powder having an average particle size of 0.1 to 5 μm can also be used, as already mentioned above. Ultra fine metal powder includes, for example, powders of Ag, Co, Cu, Fe, Mn, Ni, Pd, Sn, Te, etc. obtained by thermal plasma evaporation. The average particle size is 0.01 to 5 μm, preferably 0.01 to 0.1 μm, more preferably 0.03 to 0.07 μm. Below 0.01 μm, a secondary coagulation takes place, whereas above 5 μm the powder settles down in the electrodeposition paint, and the dispersibility of electroconductive particles in the resin layer is liable to not be uniform.

Metal-plated resin powder in the present invention includes, for example, fluorocarbon resin, polyethylene resin, acrylic resin, polystyrene resin, nylon resin, etc., whose surfaces are plated with Cu or Ni to a thickness of 0.05 to 3 μm, as in the case of ceramic powder.

Preferable average particle size of the resin powder is also about 0.1 to about 5 μm.

Figure 9:
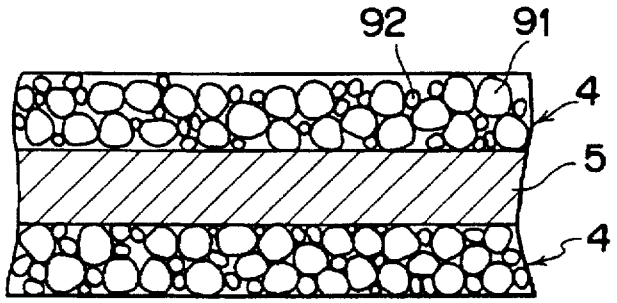
FIG. 9 is a schematic cross-sectional view of the present electroconductive adhesive member.

An electroconductive adhesive member having an excellent electromagnetic wave interceptability and excellent coating properties can be obtained by adding any of the electroconductive particles by itself to the electrodeposition film. However, when 0.2 to 3 parts by weight of ultra fine metal powder or metal-plated resin powder or their mixture is added to one part by weight of metal-plated ceramic powder or metal-plated natural mica powder or their mixture, the ultra fine metal powder and/or metal-plated resin powder 92 fills interspace between the metal-plated ceramic powder and/or metal plated natural mica powder 91 in the electrodeposition film, as shown in FIG. 9, increasing the contact area between the individual particles. Consequently, the electroconductivity of resin layer 4 is increased end thus the electromagnetic wave interceptability of the electroconductive adhesive member is much improved and the cross-linking density of the resin layer is improved due to the action of the metal-plated ceramic powder and/or metal plated natural mica powder, whereby an electroconductive adhesive member having good adhesiveness to an adherend member can be obtained.

In view of the electromagnetic wave interceptability of the electroconductive adhesive member and the adhesiveness to an adherent member, the content of electroconductive particles in the present resin layer 4 is 5 to 60% by weight, preferably 10 to 50% by weight in the cured electrodeposition film. Over 60% by weight, the adhesiveness to an adherend member is lowered, whereas below 5% by weight the electroconductivity of the resin layer 4 is not satisfactory. Thus, the electromagnetic wave interceptability of the electroconductive adhesive member is not satisfactory.

The electroconductive particles in the resin layer 4 can be identified by an X-ray microanalyzer and their content can be determined by a thermogravimetric analyzer.

A process for preparing the present electroconductive adhesive member as shown in FIG. 1B and FIG. 2 is to be explained below.

Thin metallic layers 3 are formed on a non-metallic substrate 2, for example, by electroless plating. As the nonmetallic substrate, not particularly limited, ordinary plastic materials are used. For example, ABS resin, polycarbonate resin, polyacetal resin, polyethylene terephthalate, polybutylene terephthalate, polyether imide, polypropylene, polyphenylene ether, etc. can be used.

Metallic substrate 5 includes, for example, copper, and aluminum, etc. Since flexibility is required for the electroconductive adhesive member, a resin film substrate (2) or a metallic foil substrate (5) preferably having a thickness of about 15 to about 100 μm, more preferably about 18 to about 50 μm.

On the non-metallic substrate the thin metallic layer is formed after etching, catalytic treatment, e.g. palladium treatment gives electro-conductivity, as usually carried out in the plating of plastics. The thin metallic layer is formed on a non-metallic substrate preferably by electroless plating, electrolytic plating, etc.

Then, the surface of the metallic substrate or plated non-metallic substrate is washed with a solvent or with an alkali such as an aqueous sodium hydroxide solution or an aqueous sodium carbonate solution to activate the surface of the substrate. Then, the substrate is dipped in an electrodeposition paint containing an electrodepositable adhesive resin and electroconductive particles, both are dissolved and dispersed therein, and the adhesive resin and the electroconductive particles are deposited onto the substrate by electrodeposition using the substrate as a cathode when the resin is cationic or as an anode when the resin is anionic applying necessary voltage. The reason why the resin and the electroconductive particles deposit together is considered as follows: The functional groups on the electrodepositable resin are ionized in the electrodeposition paint and the resin is attracted to a member to be deposited by applying a DC voltage between the member and the counter electrode, and the resin is adsorbed on the electroconductive particles in the electrodeposition paint and thus the electroconductive particles migrate as the resin migrates toward the member to be deposited and deposit on it with the resin.

In the present invention, it is preferable that the electrodepositable adhesive resin is ionized at least in the solvent in the electrodeposition paint and has an adhesiveness of at least 1 kg/cm when the resin layer 4 deposited by electrodeposition and the adherend member to each other and then cured. Such resin may be appropriately selected from the resins so far used for the electrodeposition paints. That is, in the case of anionic electrodeposition paints, it is preferable to use resins or prepolymers having or being introduced with anionic functional groups such as carboxylic groups to give the necessary negative charge and hydrophilic property for the deposition of the resins, whereby after the cross-linking resin layer 4 deposited by electrodeposition, it has an adhesiveness of 1 kg/cm or more to the adherend member.

In the case of cationic electrodeposition paints, it is preferable to use resins or prepolymers having or introduced with cationic functional groups such as amino groups to give the necessary positive charge for the deposition of the resins and hydrophilic property, where the resin layer 4 deposited by electrodeposition can show the desired adhesiveness as mentioned above. Specifically, a resin or prepolymer having the required adhesiveness can be selected from acrylic resin, epoxy resin, polyester resin, polyamide resin, acrylmelamine resin, alkyd resin and their prepolymers, each having anionic or cationic functional groups.

In order to improve the adhesive property of the resin layer 4, a cross-linking agent such as melamine resin, block polyisocyanate, etc., a tackifying agent such as terpene resin, terpene-phenol resin, cumarone resin, etc. and/or a softening agent such as polybutene, polyisoprene, etc. may be added to the electrodeposition paint. The cross-linking agent, tackifying agent and softening agent may or may not be electrodepositable, because even the non-electrodepositable components can be deposited with deposition of the electrodepositable adhesive resin onto the substrate in the same manner as with the electroconductive particles.

The electrodeposition is carried out under an applied voltage of 50 to 200 V, preferably 70 to 170 V, for 30 to 180 seconds, preferably 120 to 180 seconds. The pH of the electrodeposition paint is 8 to 10 for the anionic paint and 4 to 7 for the cationic paint, and the electrodeposition temperature is preferably 20° to 30° C.

In order to make the electroconductive adhesive member show a distinguished electromagnetic wave interceptability and a satisfactory adhesiveness, the thickness of the resin layer 4 is 3 to 30 μm, preferably 7 to 20 μm.

The present electrodeposition paint can be prepared by dispersing electroconductive particles and an electrodepositable adhesive resin in a ball mill for 24 to 35 hours and then diluting the resulting mixture with deionized water to a concentration of 7 to 15% by weight, preferably 10 to 15% by weight. A pigment can be added to the electrodeposition paint, when required, to color the paint. The amount of the pigment to be added for the coloration is preferably 1 to 3% by weight.

A preferable ratio of the electroconductive particles to the electrodepositable adhesive resin is 1 to 70 parts by weight, more preferably 10 to 50 parts by weight, of the electroconductive particles to 100 parts by weight of the electrodepositable adhesive resin. Within this range, a sufficient amount of the electroconductive particles to give the wave interceptability can be deposited and without precipitation of the electroconductive particles in the electrodeposition paint, and also the resin layer 4 shows a satisfactory adhesiveness to the substrate and a satisfactory flexibility after curing.

As the electroconductive particles to be dispersed in the electrodeposition paint, particles depositable together with the electrodepositable adhesive resin onto the substrate, for example, metal-plated ceramic powder, metal-plated natural mica powder, or their mixture can be used. Furthermore an ultra fine metal powder having an average particle size of 0.01 to 5 μm or metal-plated resin powder having an average particle size of 0.1 to 5 μm, or their mixture can be added to the above-mentioned metal-plated ceramic powder, metal-plated natural mica powder or their mixture.

After the completion of the electrodeposition, the substrate 2 or 5 with the formed resin layer 4 is washed with water to obtain the present electroconductive adhesive member.

The thus obtained electroconductive adhesive member is attached to an adherend member such as an outer cover, etc., as shown in FIG. 1A, and then the resin layer 4 is allowed to cross-link and cure by heating, light exposure or standing at room temperature, to bond the electroconductive adhesive member to the adherend member. Thus providing an electromagnetic wave interceptability to the adherend member.

Figure 3A:
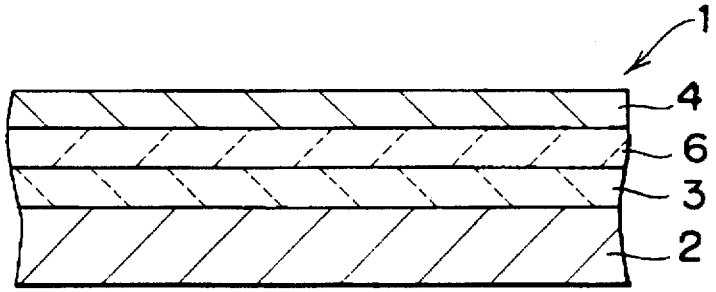
FIG. 3A and FIG. 3B are cross-sectional views of the other embodiments of the present electroconductive adhesive member where
Figure 3B:
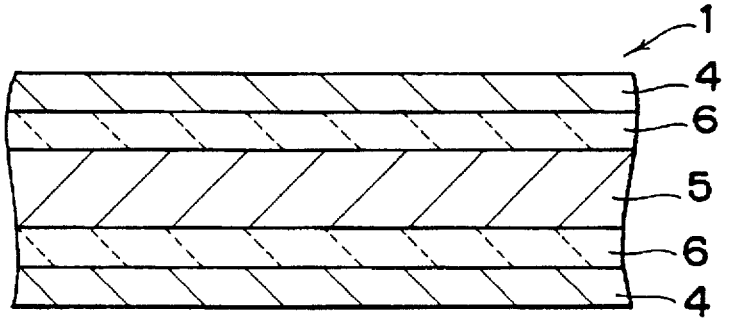

In the present invention, the adhesiveness of the resin layer 4 to the substrate can be improved when electrodeposition is carried out after a chemically colored film 6 is formed on the surface of metallic substrate 5 or non-metallic substrate 2 having a thin metal layer 3, as shown in FIG. 3A and FIG. 3B. Particularly the chemically colored film obtained by surface treatment of the thin metal layer 3 formed on the substrate 2 or by surface treatment of the substrate 5, shows excellent adhesiveness to the resin layer 4, that is, the tight adhesion of the substrate to the resin layer 4 can be further improved. The reason why the chemically colored film shows excellent adhesiveness to the resin layer 4 has not been clarified yet, but it seems that the chemically colored film has many minute pores on the surface, resulting in physical adsorption of the electrodeposited layer to the chemically colored film and also in occurrence of chemical adsorption to the chemically colored film of the functional groups of the polymers and the active surfaces of the electroconductive particles in the electrodeposition layer, and thus a distinguished tight adhesion occurs. Furthermore, the chemically colored film obtained by the surface treatment of copper in the present invention, for example, copper oxide, cuprous oxide, copper carbonate, copper sulfide, ammonium copper hydroxide, etc. shows a distinguished adhesiveness to the resin layer. Copper oxide is particularly preferable from the viewpoints of tight adhesion of the resin layer to the substrate, corrosion resistance of thin metal layer 3 or substrate 5, and uniformity of the resin layer. Thus, it is preferable in the present invention to use copper as a thin metal layer 3 and when materials other than copper are used as a metallic substrate, it is preferable to plate the material surface with copper. The thin metal layer 3 serves as an electrode for forming the resin layer on it and also allows the formation of the chemically colored film on it. The thickness of the thin metal layer is 0.01 to 0.2 μm, preferably 0.05 to 0.15 μm. Above 0.2 μm, prolonged time is required for the formation of the thin copper layer, and the working efficiency is unpreferably lowered with increasing weight of the electroconductive adhesive member.

When the electrodeposition layer is formed directly on the thin copper layer, copper dissolves into the electrodeposition paint and accumulates therein giving an adverse effect on the physical properties of the film. When the resin layer 4 is formed on the copper oxide film (the chemically colored film), the copper elution can be prevented, and no copper ions are found in the electrodeposition paint.

The chemically colored film can be formed in the following manner. For example, a copper oxide layer can be formed by dipping a substrate with a copper plating layer on the surface into a liquid mixture of copper sulfate or potassium chlorate, a liquid mixture of copper chloride, copper acetate and alum. A copper sulfide layer can be formed by dipping into a liquid mixture of potassium sulfide and ammonium chloride, or a liquid mixture of sodium hyposulfite and lead acetate. A copper hydroxide layer can be formed by dipping into a liquid mixture of copper nitrate, ammonium chloride and acetic acid. A cuprous oxide layer, one of the oxide layers, can be formed by dipping into a liquid mixture of copper sulfate end sodium chloride or a liquid mixture of copper sulfate and ammonium chloride.

When the electroconductive adhesive member is prepared with the metallic substrate 5, resin layers 4 are formed on both sides of the substrate 5, as shown in FIG. 2. To form the resin layer 4 on one side, the other side of the substrate 5 is laminated with a resin film or coated with an insulating paint.

Figure 4:
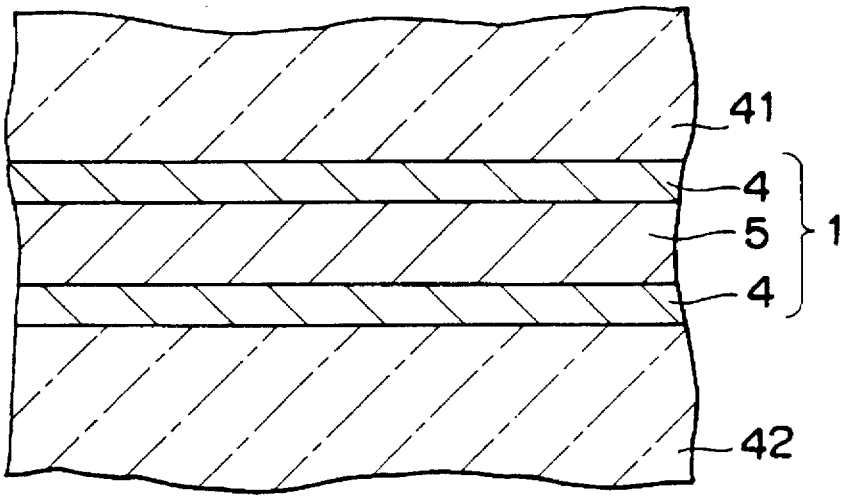
FIG. 4 is a cross-sectional view in part of electroconductive members bonded with the present electroconductive adhesive member.
Figure 5:
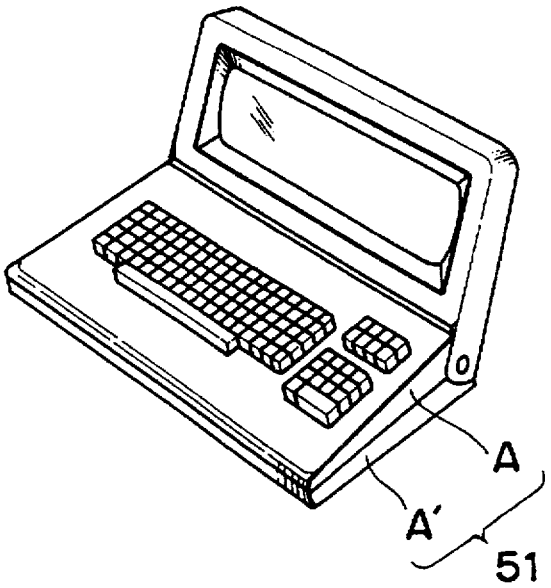
FIG. 5 is a perspective view of a lap-top personal computer using the present electroconductive member.

The electroconductive adhesive member 1 comprising a metallic substrate 5 and resin layers 4 formed on both sides of the substrate 5, as shown in FIG. 2, can bond to electroconductive case members 41 and 42, while maintaining the electrical conductance, as shown in FIG. 4. Thus, it is not necessary to use an electrically conducting means between the case members, such as washers, lead wires or damping screws so far used in the electroconductive member comprising at least two electroconductive case members, and an electroconductive member can be obtained by using the present electroconductive adhesive member in the joint between the case members. For example, the present invention can be applied to an outer cover 51 of a lap-top personal computer, as shown in FIG. 5, that is, the present invention can reduce the size, weight and production cost of the electroconductive covers and shield cases of electronic equipment.

As explained above, the present invention can provide an electroconductive adhesive member having an excellent adhesiveness and an uniform and excellent electromagnetic wave interceptability.

Furthermore, the present invention can provide an electroconductive cover comprising at least two case members, strongly bonded and electrically conducted to one another at the joint therebetween.

The present invention will be described in detail below, referring to the Examples, but the present invention is not limited thereto.

Particle size of powder was determined by a particle size distribution analyzer of centrifugal precipitation (commercial name type SACP-3 made by Shimazu K.K.), where the individual particles of powder were regarded as dense spheres of equal particle size.

The electroconductive particles in an electrodeposition film were identified by an X-ray microanalyzer and the amount of the electroconductive particles was analyzed by a thermogravimetric analyzer (Thermal Analysis System 7 series, trademark of Parkin-Elmer Co.).

The adhesiveness was determined according to Peeling Test Procedure (JIS C 6491).

Figure 6:
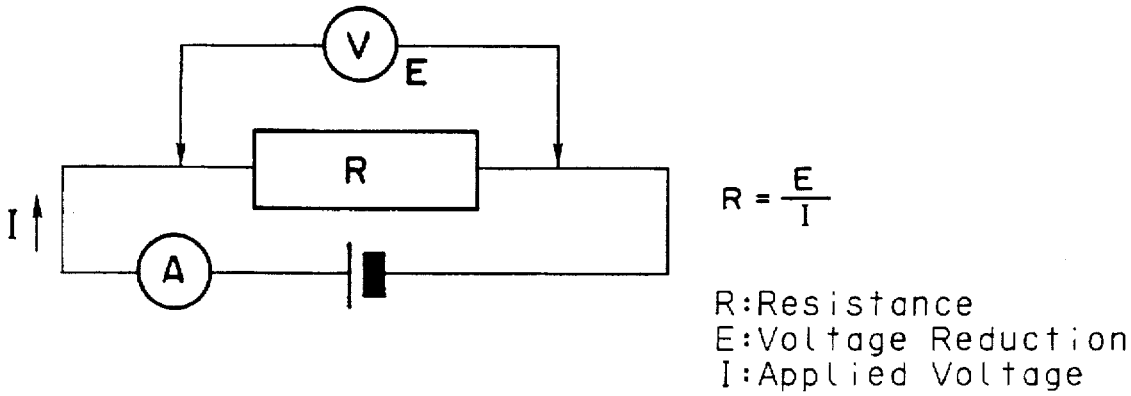
FIG. 6 shows a circuit used in the measurement of surface resistivity.

The contact resistance was determined by a four-terminal measurement procedure using the circuit shown in FIG. 6

EXAMPLE 1-1

A substrate was prepared by applying an electroless copper plating 3 to a polyester film substrate 2 of 18 μm so as to make the thickness of the plating layer 0.2 μm.

An electrodeposition solution was prepared by mixing 60 parts by weight of polyester resin (Finetax ES-525, trademark of a product made by Dainippon Ink Kagaku K.K.), 40 parts by weight of polyester resin (Finetex 525, trademark of a product made by Dainippon Ink Kagaku Kogyo K.K.) as electrodepositable adhesive resins, 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting mixture with 40 parts by weight of electroconductive particles prepared by applying an electroless nickel plating to alumina particles having an average particle size of 1 μm to make the thickness of the electroless plating layer 0.2 μm, then subjecting the mixture to a dispersion treatment in a ball mill for 30 hours and then diluted to 15% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby resin layers 4 having a thickness of 17 μm were formed on the surfaces of substrate 2. The content of the metal-plated ceramic powder in the resin layer 4 was found to be 40% by weight.

The thus obtained electroconductive adhesive member 1 was heated in an oven at 50° C. for 10 minutes to allow cross-linking. Then, the surface resistivity of the resin layer 4 in the electroconductive adhesive member 1 was measured to evaluate whether the resin layer 4 had an electroconductivity (0.5 Ω/□ or less), which is a as a standard level for the presence of the electromagnetic wave interceptability.

Separately, as an adherend member, an ABC resin substrate was prepared by dipping in an etching solution of $CrO_3$—$H_2SO_4$—$H_2O$ system for one minute, washing with water and dipping in a liquid mixture composed of 30 g/l of stannous chloride and 20 ml/l of hydrochloric acid for 2 minutes. Then, the electroconductive adhesive member was attached to the etched Abs resin substrate through the resin layer 4 before cross-linking, and then heated at 50° C. for 10 minutes to complete adhesion. The thus obtained adhesion product was used as a test piece to determine the adhesiveness between the present electroconductive adhesive member and the ABS resin substrate, thereby evaluating whether the present electroconductive adhesive member has an adhesiveness of 1 kg/cm or more.

EXAMPLE 1-2

A copper foil substrate 5 having a thickness of 18 μm was subjected to degreasing with an alcohol solvent, further degreasing with an alkali cleaner (Pakuna No.19 trademark of a product made by Yuken Kagaku K.K.) for one minute, water washing, washing with 10% sulfuric acid for 30 seconds and washing with water and then with deionized water to activate the surface of the substrate.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.) as electrodepositable adhesive resins, 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting mixture with 50 parts by weight of electroconductive particles, prepared by applying an electroless nickel plating to alumina particles having an average particle size of 1 μm to make the thickness of electroless plating layer 0.2 μm, then subjecting the mixture to a dispersion treatment in a ball mill for 30 hours and then diluting the dispersion to 15% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby resin layers 4 having a thickness of 18 μm were formed on both sides of substrate 5 to obtain an electroconductive adhesive member 1. The content of the metal-plated ceramic powder in the resin layer 4 was found to be 45% by weight.

The thus obtained electroconductive adhesive member 1 was heated in an oven at 50° C. for 10 minutes to allow cross-linking. Then, the surface resistivity of the resin layer 4 of the electroconductive adhesive member 1 was measured to evaluate whether the resin layer 4 had an electroconductivity (0.5 Ω/□ or less), which is a standard level for the electromagnetic wave interceptability.

Separately, the electroconductive adhesive member before the cross-linking of this Example was attached to the surface-etched ABS resin substrate which was previously dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the adherend member is in contact with the resin layer 4, and then heated at 50° C. for 10 minutes to complete adhesion. The adhesion product thus obtained was used as a test piece to determine the adhesiveness of the present electroconductive adhesive member to the ABS resin substrate, thereby evaluating whether the present electroconductive adhesive member has an adhesiveness of 1kg/cm or more.

EXAMPLE 1-3

An aluminum substrate 5 having a thickness of 18 μm was subjected to degreasing with an alcohol solvent, followed by degreasing with an aqueous sodium carbonate solution containing a small amount of an anionic surfactant for 2 minutes, and washed with water and then with deionized water to activate the surface.

An electrodeposition solution was prepared by mixing 70 parts by weight of polyester resin (Finetex ES-525, trademark of a product made by Dainippon Ink Kagaku K.K.), 30 parts by weight of polyester resin (Finetex 675, trademark of a product made by Dainippon Ink Kagaku K.K.) as electrodepositable adhesive resins, 6 parts by weight of a cross-linking agent (Backamine PM-N, a product made by Dainippon Ink Kagaku K.K.) and 3 parts by weight of a catalyst (Cat ES-2, a product made by Dainippon Ink Kagaku K.K.), then admixing the resulting mixture with 30 parts by weight of electroconductive particles prepared by applying an electroless nickel plating to alumina particles having an average particle size of 0.3 μm to make the thickness of the electroless plating layer 0.2 μm, then subjecting the mixture to a dispersion treatment in a ball mill for 30 hours and then diluting the dispersion to 10% by weight with deionized water.

Electrodeposition was carried out in the electrodeposition solution, using the substrate as an anode and a stainless steel plate as a cathode at 25° C. and pH 9 under an applied voltage of 120 V for 3 minutes, whereby a resin layer 4 having a thickness of 22 μm was formed on both sides of substrate 5 to obtain an electroconductive adhesive member 5. The total content of the metal-plated ceramic powder in the resin layer 4 was found to be 25% by weight.

In the same manner as in Example 1-1, the thus obtained member was attached onto a surface-activated ABS resin substrate as an adherend member through resin layer 4, and then cured at the room temperature to complete adhesion. The adhesion product thus obtained was used as a test piece to determine the adhesiveness of the present electroconductive adhesive member to the ABS resin substrate.

Separately, the electroconductive adhesive member was cured by itself and the surface resistivity of the resin layer 4 was measured.

EXAMPLE 1-4

A polyethylene terephthalate film 2 having a thickness of 18 μm was subjected to electroless copper plating to both surfaces of the substrate, and then degreasing with an alcohol solvent, further degreasing with an alkali cleaner (Pakuna No.19, trademark of a product made by Yuken Kagaku K.K.) for one minute, water washing and then washing with 10% sulfuric acid, with water and then with deionized water to activate the surface of the copper layer.

An electrodeposition solution was prepared by mixing 70 parts by weight of polyester resin (Finetax ES-525, trademark of a product made by Dainippon Ink Kagaku K.K.), 30 parts by weight of polyester resin (Finetex 525, trademark of a product made by Dainippon Ink Kagaku K.K.) as electrodepositable adhesive resins, 6 parts by weight of a cross-linking agent (Permastat R-5, a product made by Dainippon Ink Kagaku K.K.) and 3 parts by weight of a catalyst (Cat PA-20, a product made by Dainippon Ink Kagaku K.K.), then admixing the resulting mixture with 50 parts by weight of electroconductive particles prepared by applying an electroless nickel plating to alumina particles having an average particle size of 1 μm to make the thickness of electroless plating layer 0.2 μm, then subjecting the mixture to a dispersion treatment in a ball mill for 30 hours and then the dispersion was diluted to 15% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby resin layers 4 having a thickness of 18 μm were formed on both sides of substrate 2, to obtain an electroconductive adhesive member. The total content of the metal-plated ceramic powder in the resin layer 4 was found to be 50% by weight.

Then, in the same manner as in Example 1-1, the thus obtained member was attached onto a surface-activated ABS resin substrate as an adherend member through the resin layer 4, and then heated at 90° C. for 10 minutes to complete adhesion. The product thus obtained was used as a test piece to determine the adhesiveness in the same manner as in Example 1-1.

Separately, the electroconductive adhesive member was heated by itself at 90° C. for 10 minutes, and then the surface resistivity of the resin layer 4 was measured.

EXAMPLE 1-5

A polyester film substrate 2 in a mesh form having a thickness of about 18 μm and of 100 to 250 mesh was subjected to electroless copper plating on both sides to a thickness of 0.2 μm in the same manner as in Example 1-1, and then dipped in a liquid mixture of 5% sodium hydroxide and 1% potassium persulfate at 70° C. for 30 seconds to form a copper oxide film as a chemically colored film.

An electrodeposition solution was prepared by mixing 60 parts by weight of polyester resin (Finetex ES-525, trademark of a product made by Dainippon Ink Kagaku K.K.), 40 parts by weight of polyester resin (Finetex 675, trademark of a product made by Dainippon Ink Kagaku K.K.) as electrodepositable adhesive resins, 7 parts by weight of a cross-linking agent (Backamine PM-M, a product made by Dainippon Ink Kagaku K.K.) and 3 parts by weight of a catalyst (Cat ES-2, a product made by Dainippon Ink Kagaku K.K.), then admixing the resulting mixture with 60 parts by weight of electroconductive particles prepared by applying an electroless nickel plating to alumina particles having an average particle size of 0.3 μm to make the thickness of electroless plating layer 0.2 μm, then subjecting the mixture to a dispersion treatment in a ball mill for 30 hours and then the dispersion was diluted to 10% by weight with deionized water.

Electrodeposition was carried out in the electrodeposition solution, using the substrate as an anode and a stainless steel plate as a cathode at 25° C. and pH 9 under an applied voltage of 120 V for 3 minutes, whereby resin layers 4 having a thickness of 23 μm were formed on both sides of the substrate to obtain an electroconductive adhesive member. The content of the metal-plated ceramic powder in the resin layer 4 was found to be 50% by weight.

Then, in the same manner as in Example 1-1, the thus obtained member was pasted onto a surface-treated ABS resin substrate through the resin layer 4, and then cured at the room temperature to complete adhesion. The product thus obtained was used as a test piece to determine the adhesiveness and the surface resistivity of the resin layer 4 in the same manner as in Example 1-1.

COMPARATIVE EXAMPLE 1

100 parts by weight of an epoxy adhesive (Cemedine U-121, trademark of a product made by Cemedine K.K.) as an electroconductive adhesive and 10 parts by weight of copper particles having an average particle size of 0.2 μm were mixed and sprayed onto the same polyester substrate used in Example 1-1 to form an electroconductive adhesive layer having a thickness of 10 μm. The thus treated substrate was used as an electroconductive adhesive member, and pasted on the same surface-treated ABS resin substrate as used in Example 1-1 and the adhesive resin was cured.

The adhesiveness and surface resistivity of the electroconductive adhesive member after the curing was determined in the same manner as in Example 1-1.

COMPARATIVE EXAMPLE 2

100 parts by weight of an ethylenic adhesive (Himiran, trademark of a product made by Mitsui Polychemical K.K.) as an electroconductive adhesive and 15 parts by weight of copper particles having an average particle size of 0.5 μm were mixed and sprayed onto the bonding surface of the same polyester substrate as used in Example 1-1 to form an electroconductive adhesive layer having a thickness of 10 μm. The thus treated substrate was used as an electroconductive adhesive member, and pasted on the same surface-treated ABS resin substrate as used in Example 1-1, and the adhesive was cured.

The adhesiveness and surface resistivity of the electroconductive adhesive member after the curing was determined in the same manner as in Example 1-1.

Adhesiveness and surface resistivity in the foregoing Examples 1-1 to 1-5 and comparative Examples 1 and 2 are shown in Table 1-1.

TABLE 1-1

| | Adhesiveness (kg/cm) | Surface resistivity (Ω/□) |
|---|---|---|
| Example 1-1 | 3~4 | 0.01 |
| 1-2 | 3~4 | 0.01 |
| 1-3 | 4~5 | 0.02 |
| 1-4 | 3~5 | 0.01 |
| 1-5 | 3~4 | 0.02 |
| Comp. Ex. 1 | 0.5 | 0.7 |
| 2 | 0.5 | 0.4 |

It is apparent from the foregoing results that the present electroconductive adhesive members have distinguished adhesiveness and a high electromagnetic wave intercepting effect.

EXAMPLE 1-6

An ABS resin case composed of two case members A and A', which constituted the outer cover 51 of a lap-top personal computer body, as shown in FIG. 5, was dipped in an etching solution of $CrO_3$—$H_2SO_4$—$H_2O$ system for one minute, washed with water, dipped in a liquid mixture containing 30 g/l of stannous chloride and 20 g/l of hydrochloric acid as a sensitizer solution at room temperature for 2 minutes and then washed with water to conduct surface etching.

Then, the same electroconductive adhesive member as prepared in Example 1-1 was pasted on the entire inner surfaces of the case members A and A' and heated at 50° C. for 10 minutes to cure the electroconductive adhesive member. Then, the case members A and A' were bonded to each other to make the outer cover.

Figure 7:
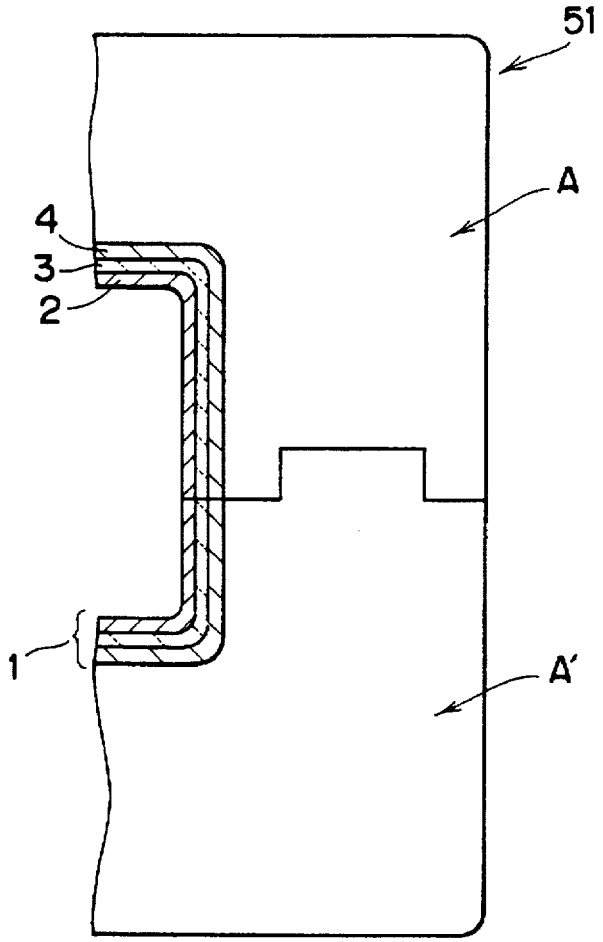
FIG. 7 is a cross-sectional view of the lap-top personal computer body shown in FIG. 5.
Figure 8:
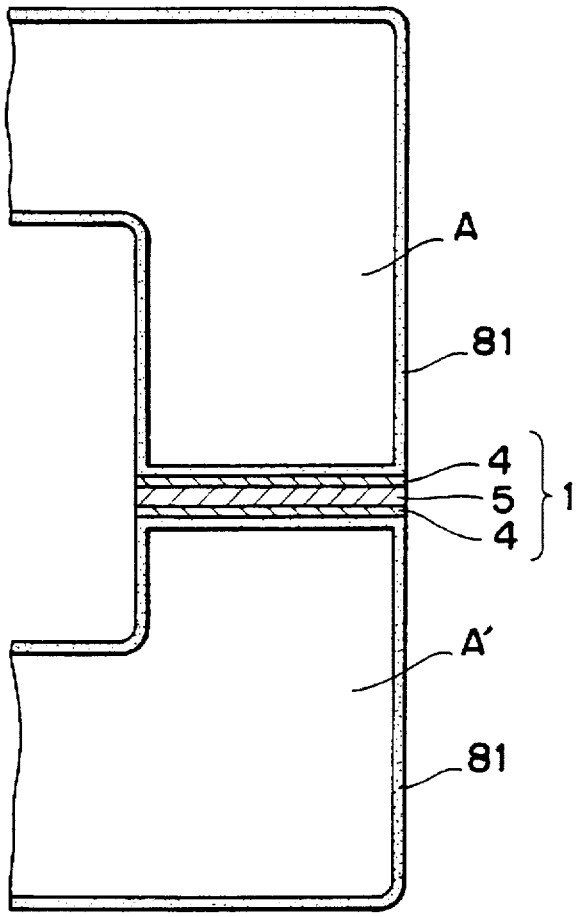
FIG. 8 is a cross-sectional view of another embodiment of the lap-top personal computer shown in FIG. 5.

The cross-section of the outer cover is illustrated in FIG. 7. Electroconducting between the case members A and A' were made with screws and lead wires.

The electromagnetic wave interceptability of the thus prepared outer cover was determined by transmission line procedure (ASTM ES 7.83 procedure) and it was shown that attenuation was 30 to 40 dB on average and the electromagnetic wave interceptability passed the VCCI regulation.

EXAMPLE 2-1

A substrate was prepared by applying an electroless copper plating to a polyester substrate 2 having a thickness of 18 μm so as to make the thickness of the plating layer 0.2 μm.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.) as electrodepositable adhesive resins, 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting mixture with 30 parts by weight of fine copper powder having an average particle size of 0.02 μm and 20 parts by weight of electroconductive particles prepared by applying an electroless nickel plating to alumina particles having an average particle size of 1 μm to make the thickness of electroless plating layer 0.2 μm, then subjecting the mixture to a dispersion treatment in a ball mill for 30 hours and then the dispersion was diluted to 15% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby resin layers 4 having a thickness of 16 μm were formed on both sides of the substrate to obtain an electroconductive adhesive member. The total content of the metal-plated ceramic powder and the fine copper powder in the resin layer 4 was found to be 47% by weight.

The thus obtained electroconductive adhesive member 1 was heated in an oven at 50° C. for 10 minutes to conduct cross-linking. Then, the surface resistivity of the resin layer 4 of the electroconductive adhesive member 1 was measured to evaluate whether the resin layer 4 had an electroconductivity (0.5 Ω/□ or less), which is a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the electroconductive, adhesive member not cross-linked of this Example was attached onto the thus obtained surface-etched ABS resin substrate as an adherend member so that the adherend member was in contact with the resin layer 4, and then heated at 50° C. for 10 minutes to complete adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 2-2

A substrate was prepared in the following manner. That is, an electroless copper plating 3 was applied to both sides of a polyester film substrate 2 of a mesh form having a thickness of about 18 μm and 100 to 250 meshes, in the same manner as in Example 1-1 so as to make the thickness of the electroless copper plating 0.2 μm. Then, the substrate was dipped in an aqueous solution containing 5% by weight of sodium hydroxide and 1% by weight of potassium persulfate at 70° C. for 30 seconds to form a copper oxide film as a chemically colored film thereon.

An electrodeposition solution was prepared by mixing 60 parts by weight of polyester resin (Finetex ES-525, trademark of a product made by Dainippon Ink Kagaku K.K.), 40 parts by weight of polyester resin (Finetax 675, trademark of a product made by Dainippon Ink Kagaku K.K.) as electrodepositable adhesive resins, 7 parts by weight of a cross-linking agent (Beckamine PM-N, a product made by Dainippon Ink Kagaku K.K.) and 3 parts by weight of a catalyst (Cat ES-2, a product made by Dainippon Ink Kagaku K.K.), then admixing the resulting adhesive with 30 parts by weight of fine nickel powder having an average particle size of 0.05 μm, and 30 parts by weight of electroconductive particles prepared by applying an electroless nickel plating to alumina particles having an average particle size of 0.3 μm- to make the thickness of electroless plating layer 0.2 μm, then subjecting the mixture to a dispersion treatment in a ball mill for 30 hours and then the dispersion was diluted to 10% by weight with deionized water.

Electrodeposition was carried out in the electrodeposition solution, using the substrate as an anode and a stainless steel plate as a cathode at 25° C. and pH 9 under an applied voltage of 120 V for 3 minutes, whereby a resin layer 4 having a thickness of 21 μm was formed on both sides of the substrate to obtain an electroconductive adhesive member. The total content of the metal-plated ceramic powder and the fine copper powder in the resin layer 4 was found to be 42% by weight.

The thus obtained electroconductive adhesive member 1 was heated in an oven at 50° C. for 10 minutes to complete cross-linking. Then, the surface resistivity of the resin layer 4 in the electroconductive adhesive member 1 was measured to evaluate whether the resin layer 4 had sufficient electroconductivity (0.5 Ω/□ or less ), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the electroconductive adhesive member not cross-linked of this Example was attached onto thus obtained surface-etched ABS resin substrate as an adherend member, so that the adherend member was in contact with the resin layer 4, and then heated at 50° C. for 10 minutes to complete adhesion. The adhesion product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 2-3

A substrate was prepared in the following manner. That is, a copper foil substrate 5 having a thickness of 18 μm was degreased with an alcohol solution and then with an alkali cleaver (Pakuna No.19, trademark of a product made by Yuken Kagaku K.K.) for one minute, then with water, then with 10% sulfuric acid for 30 seconds, with water and finally with deionized water to activate the surface of the substrate.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.) as electrodepositable adhesive resins, 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting adhesive with 30 parts by weight of fine nickel powder having an average particle size of 0.02 μm, and 20 parts by weight of electroconductive particles prepared by applying an electroless nickel plating to alumina particles having an average particle size of 1 μm with the thickness of electroless plating layer 0.2 μm, then subjecting the mixture to a dispersion treatment in a ball mill for 30 hours end then the dispersion was diluted to 15% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby resin layers 4 having a thickness of 17 μm were formed on both sides of the substrate to obtain an electroconductive adhesive member. The total content of the metal-plated ceramic powder and the fine copper powder in the resin layer 4 was found to be 47% by weight.

The thus obtained electroconductive adhesive member 1 was heated in an oven at 50° C. for 10 minutes to complete cross-linking. Then, the surface resistivity of the resin layer 4 of the electroconductive adhesive member 1 was measured to evaluate whether the resin layer 4 had sufficient electroconductivity (0.5 Ω/□ or less), which is a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example was attached onto the thus obtained surface-etched ABS resin substrate as an adherend member so that the adherend member was in contact with the resin layer 4, and then heated at 50° C. for 10 minutes to complete adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 2-4

A substrate was prepared in the following manner. That is, an aluminum substrate 5 having a thickness of 18 μm was degreased with an alcohol solvent, then treated with a degreasing agent, an aqueous sodium carbonate solution containing a small amount of an anionic surfactant for 2 minutes, and washed with water and then with deionized water to activate the surface of the substrate.

An electrodeposition solution was prepared by mixing 70 parts by weight of polyester resin (Finetex ES-525, trademark of a product made by Dainippon Ink Kagaku K.K.), 30 parts by weight of polyester resin (Finetex 675, trademark of a product made by Dainippon Ink Kagaku K.K.) as electrodepositable adhesive resins, 6 parts by weight of a cross-linking agent (Beckamine PM-N, a product made by Dainippon Ink Kagaku K.K.) and 3 parts by weight of a catalyst (Cat ES-2, a product made by Dainippon Ink Kagaku K.K.), then admixing the resulting mixture with 40 parts by weight of fine nickel powder having an average particle size of 0.05 μm, and 10 parts by weight of electroconductive particles prepared by applying an electroless nickel plating to alumina particles having an average particle size of 0.3 μm with the thickness of electroless plating layer 0.2 μm, then subjecting the mixture to a dispersion treatment in a ball mill for 30 hours and then the dispersion was diluted to 10% by weight with deionized water.

Electrodeposition was carried out in the electrodeposition solution, using the substrate as an anode and a stainless steel plate as a cathode at 25° C. and pH 9 under an applied voltage of 120 V for 3 minutes, whereby resin layers 4 having a thickness of 22 μm were formed on both sides of the substrate to obtain an electroconductive adhesive member. The total content of the metal-plated ceramic powder and the fine copper powder in the resin layer 4 was found to be 37% by weight.

The thus obtained electroconductive adhesive member 1 was heated in an oven at 50° C. for 10 minutes to perform cross-linking. Then, the surface resistivity of the resin layer 4 of the electroconductive adhesive member 1 was measured to evaluate whether the resin layer 4 had sufficient electroconductivity (0.5 Ω/□ or less), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example was attached onto the thus obtained surface-etched ABS resin substrate as an adherend member so that the adherend member was in contact with the resin layer 4, and then heated at the ordinary temperature to perform adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 2-5

A substrate was prepared in the following manner. That is, a copper foil substrate having a thickness of 18 μm was degreased with an alcohol solvent, then with an alkali cleaner (Pakuna No.19, trademark of a product made by Yuken Kagaku K.K.) for one minute, and then washed with water, then with 10% sulfuric acid for 30 seconds, washed with water and finally with deionized water to activate the surface of the substrate.

An electrodeposition solution was prepared by mixing 70 parts by weight of polyester resin (Finetex ES-525, trademark of a product made by Dainippon Ink Kagaku K.K.), 30 parts by weight of polyester resin (Finetex 525, trademark of a product made by Dainippon Ink Kagaku K.K.), 6 parts by weight of a cross-linking agent (Permastat R-5, a product made by Dainippon Ink Kagaku K.K.) and 3 parts by weight of a catalyst (Cat PA-20, a product made by Dainippon Ink Kagaku K.K.), then admixing the resulting adhesive with 20 parts by weight of fine copper powder having an average particle size of 0.07 μm, and 50 parts by weight of electroconductive particles prepared by applying an electroless nickel plating to alumina particles having an average particle size of 1 μm with the thickness of electroless plating layer 0.2 μm, then subjecting the mixture to a dispersion treatment in a ball mill for 30 hours and then the dispersion was diluted to 5% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby resin layers 4 having a thickness of 17 μm were formed on both sides of substrate to obtain an electroconductive adhesive member. The total content of the powdery mixture of the metal-plated ceramic powder and the fine copper powder in the resin layer 4 was found to be 25% by weight.

The thus obtained electroconductive adhesive member 1 was heated in an oven at 90° C. for 10 minutes to perform cross-linking. Then, the surface resistivity of the resin layer 4 in the electroconductive adhesive member 1 was measured to evaluate whether the resin layer 4 had sufficient electroconductivity (0.5 Ω/□ or less), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example, was attached onto the thus obtained surface-etched ABS resin substrate as an adherend member so that the adherend member was in contact with the resin layer 4, and then heated at 90° C. for 10 minutes to perform adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

The adhesiveness and the surface resistivity of the electroconductive adhesive members prepared in Examples 2-1 to 2-5 are given in Table 2-1.

TABLE 2-1

| Example No. | Adhesiveness (kg/cm) | Surface resistivity (Ω/□) |
|---|---|---|
| 2-1 | 5–6 | 0.001 |
| 2-2 | 5–7 | 0.001 |
| 2-3 | 6–6.5 | 0.001 |
| 2-4 | 5–6 | 0.001 |
| 2-5 | 4–5 | 0.005 |

EXAMPLE 2-6

The same electroconductive adhesive member 1 as obtained in Example 2-1 was tightly attached to the entire inner surfaces of the same resin case members A and A' as obtained in Example 2-1 and heated at 50° C. for 10 minutes to complete adhesion. Then, the case members A and A' were assembled to make an outer cover for a L.T. personal computer (electrical conduction between the case members were the same as in Example 1-6).

The electromagnetic wave intercepting effect of the thus prepared outer cover was determined by the transmission line procedure and it was found that the attenuation was extremely good, for example, about 80 dB in a frequency band of 50 to 1,000 MHz.

EXAMPLE 2-7

Two ABS resin case members A and A' formed as an outer cover 51 for a lap-top personal computer body, as shown is FIG. 5, were dipped in an etching solution of $CrO_3$—$H_2SO_4$—$H_2O$ system for one minute, washed with water, dipped in a liquid mixture containing 30 g/l of stannous chloride and 20 g/l of hydrochloric acid as a sensitizer solution at room temperature for 2 minutes, washed with water, and then treated in a liquid activator solution containing 0.3 g/l of palladium chloride and 3 ml/l of hydrochloric acid at room temperature for 2 minutes to give electroconductivity. Then, a copper plating film 81 having a thickness of 0.7 μm was formed on the entire surfaces of the case members A and A' with an electroless copper plating solution (made by Okuno Seiyaku Kogyo K.K.) at pH 13.0.

Then, the case members A and A' were bonded to each other with the same electroconductive adhesive member 1 as obtained in Example 2-3 and heated at 50° C. for 10 minutes to prepare an outer cover 51. No other electroconducting means was used between the case members.

The electromagnetic wave intercepting effect of the thus prepared outer cover was determined by the transmission line procedure and it was found that very good attenuation such as 70 to 80 dB on average was obtained in a frequency band of 50 to 1,000 MHz, and that a satisfactory electroconduction was obtained between the case members A and A' using the electroconductive adhesive member 1.

EXAMPLE 3-1

A substrate was prepared in the following manner. That is, an electroless copper plating was applied to one side of a polyester film substrate 2 having a thickness of 18 μm so as to make the thickness of the electroless plating layer 0.2 μm. Then, the substrate 1 was degreased with an alcohol solvent and then with an alkali cleaner (Pakuna No.19, trademark of a product made by Yuken Kagaku K.K.) for one minute, and then washed with water, with 10% sulfuric acid for 30 seconds, with water and finally with deionized water to activate the surface of the copper thin layer.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.) as electrodepositable adhesive resins, 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting adhesive with 40 parts by weight of electroconductive particles prepared by applying an electroless nickel plating to natural mica powder having an average particle size of 1 μm with the thickness of electroless plating layer 0.2 μm, then subjecting the mixture to a dispersion treatment in a ball mill for 30 hours and then the dispersion was diluted to 15% by weight with deionized water.

Electrodeposition was carried out in the electrodeposition solution, using the substrate 1 as an anode and a stainless steel plate as a cathode at 25° C. and pH 8.5 under an applied voltage of 100 V for 3 minutes, whereby a resin layer 4 having a thickness of 17 μm was formed on both sides of substrate to obtain an electroconductive adhesive member. The content of the metal-plated natural mica powder in the resin layer 4 was found to be 40% by weight.

The thus obtained electroconductive adhesive member 1 was heated in an oven at 50° C. for 10 minutes to perform cross-linking. Then, the surface resistivity of the resin layer 4 of the electroconductive adhesive member 1 was measured to evaluate whether the resin layer 4 had an electroconductivity (0.5 Ω/□ or less), a standard level for the electromagnetic wave interceptability.

Separately, the electroconductive adhesive member before the cross-linking of this Example was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the thus obtained member was attached onto a surface-etched ABS resin substrate, so that the adherend member was in contact with the resin layer 4, and then heated at 50° C. for 10 minutes to conduct adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 3-2

A substrate was prepared by applying electroless copper plating to a polyester substrate 1 having a thickness of 18 μm so as to make the thickness of the electroless plating layer 0.2 μm.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.), 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting adhesive with 20 parts of fine copper powder having an average particle size of 0.02 μm, and 30 parts by weight of electroconductive particles prepared by applying an electroless nickel plating to mica powder having an average particle size of 1.0 μm with the thickness of electroless plating layer 0.1 μm, then subjecting the mixture to a dispersion treatment in a ball mill for 30 hours and then the dispersion was diluted to 15% by weight with deionized water.

Electrodeposition was carried out using the substrate above prepared as an anode and a stainless steel plate as a cathode at 25° C. and pH 8.5 under an applied voltage of 100 V for 3 minutes, whereby a resin layer 4 having a thickness of 16 μm was formed on one side of substrate to obtain an electroconductive adhesive member. The total content of the metal-plated mica powder and the fine copper powder in the resin layer 4 was found to be 47% by weight.

The thus obtained electroconductive adhesive member 1 was heated in an oven at 50° C. for 10 minutes to perform cross-linking. Then, the surface resistivity of the resin layer 4 in the electroconductive adhesive member 1 was measured to evaluate whether the resin layer 4 had an electroconductivity (0.5 Ω/□ or less), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example was attached to the surface-etched ABS resin substrate thus obtained as an adherend member so that the adherend member may be in contact with the resin layer 4, and then heated at 50° C. for 10 minutes to complete adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 3-3

A substrate was prepared in the following manner. That is, a copper foil substrate having a thickness of 18 μm was degreased with an alcohol solvent, then with an alkali cleaner (Pakuna No.19, trademark of a product made by Yuken Kagaku K.K.) for one minute, and then washed with water, with 10% sulfuric acid for 30 seconds, with water and finally with deionized water to activate the surface of the substrate.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.), 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting adhesive with 10 parts by weight of electroconductive particles prepared by applying an electroless nickel plating to alumina particle having an average particle size of 1 μm with the thickness of electroless plating layer 0.2 μm and 30 parts by weight of powder prepared by applying an electroless nickel plating to natural mica having an average particle size of 1.0 μm with the thickness of electroless plating layer 0.1 μm, then subjecting the mixture to a dispersion treatment in a ball mill for 30 hours and then the dispersion was diluted to 15% by weight with deionized water.

Electrodeposition was carried out using the substrate as an anode and a stainless steel plate as a cathode at 25° C. and pH 8.5 under an applied voltage of 100 V for 3 minutes, whereby a resin layer 4 having a thickness of 17 μm was formed on both sides of the substrate to obtain an electroconductive adhesive member. The total content of the metal-plated ceramic powder and the metal-plated natural mica in the resin layer 4 was found to be 40% by weight.

The thus obtained electroconductive adhesive member 1 was heated in an oven at 50° C. for 10 minutes to perform cross-linking. Then, the surface resistivity of the resin layer 4 in the electroconductive adhesive member 1 was measured to evaluate whether the resin layer 4 had an electroconductivity (0.5 Ω/□ or less), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example was attached to the surface-etched ABS resin substrate thus obtained as an adherend member so that the adherend member may be in contact with the resin layer 4, and then heated at 50° C. for 10 minutes to perform adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 3-4

A substrate was prepared in the following manner. That is, electroless copper plating was applied to one side of a polyethylene terephthalate film substrate 2 having a thickness of 18 μm. Then, the substrate was degreased with an alcohol solvent, then with an alkali cleaner (Pakuna No.19, trademark of a product made by Yuken Kagaku Kogyo K.K.) for one minute, and washed with water, then with 10% sulfuric acid for 30 seconds, with water and finally with deionized water to activate the surface of the substrate. Then, the substrate was dipped in an aqueous solution containing 5% by weight of sodium hydroxide and 1% by weight of potassium persulfate at 70° C. for 30 seconds to form a copper oxide film as a chemically colored film 6.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.), 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting adhesive with 30 parts by weight of fine copper powder having an average particle size of 0.02 μm, 10 parts by weight of electroconductive particles prepared by applying an electroless nickel plating to alumina particle having an average particle size of 1 μm with the thickness of electroless plating layer 0.2 μm and 10 parts by weight of electroconductive particles prepared by applying an electroless nickel plating to natural mica having an average particle size of 1.0 μm with the thickness of electroless plating layer 0.2 μm, then subjecting the mixture to a dispersion treatment in a ball mill for 30 hours and then the dispersion was diluted to 15% by weight with deionized water.

Electrodeposition was carried out using the substrate as an anode and a stainless steel plate as a cathode at 25° C. and pH 8.5 under an applied voltage of 100 V for 3 minutes, whereby a resin layer 4 having a thickness of 18 μm was formed on one side of substrate to obtain an electroconductive adhesive member 1. The total content of the metal-plated ceramic powder, metal-plated mica powder and fine copper powder in the resin layer 4 was found to be 47% by weight.

The thus obtained electroconductive adhesive member 1 was heated in an oven at 50° C. for 10 minutes to be cross-linked. Then, the surface resistivity of the resin layer 4 in the electroconductive adhesive member 1 was measured to evaluate whether the resin layer 4 had an electroconductivity (0.5 Ω/□ or less), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example the thus obtained member was pasted onto a surface-etched ABS resin substrate as an adherend member so that the adherend member may be in contact with the resin layer 4, and then heated at 50° C. for 10 minutes to complete adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

EXAMPLE 3-5

A substrate was prepared in the following manner was used. That is, electroless copper plating was applied to a polyester substrate having a thickness of 18 μm so as to make the thickness of the electroless plating layer 0.2 μm. Then, the substrate was dipped in an aqueous solution containing 5% by weight of sodium hydroxide and 1% by weight of potassium persulfate at 70° C. for 30 seconds to form a copper oxide film as 8 chemically colored film.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.), 5 parts by weight of a cross-linking agent (Permestat R-5, a product made by Dainippon Ink Kagaku K.K.) and 2.5 parts by weight of a catalyst (Cat PA-20, a product made by Dainippon Ink Kagaku K.K.), then admixing the resulting adhesive with 10 parts by weight of fine copper powder having an average particle size of 0.02 μm, 10 parts by weight of powder prepared by applying an electroless nickel plating to alumina having an average particle size of 1 μm with the thickness of electroless plating layer 0.2 μm, 5 parts by weight of another powder prepared by applying electroless nickel plating to natural mica having an average particle size of 1.0 μm with the thickness of electroless plating layer 0.1 μm, and 5 parts by weight of a powder prepared by applying electroless copper plating to nylon particles having an average particle size of 0.5 μm with the thickness of electroless plating layer 0.05 μm, then subjecting the mixture to a dispersion treatment in a ball mill for 30 hours and then the dispersion was diluted to 15% by weight with deionized water.

Electrodeposition was carried out in the electrodeposition solution, using the substrate as an anode and a stainless steel plate as a cathode at 25° C. and pH 8.5 under an applied voltage of 100 V for 3 minutes, whereby a resin layer 4 having a thickness of 17 μm was formed on one side of substrate to obtain an electroconductive adhesive member 1. The content of the powdery mixture in the resin layer 4 was found to be 30% by weight.

The thus obtained electroconductive adhesive member 1 was heated in an oven at 50° C. for 10 minutes to perform cross-linking. Then, the surface resistivity of the resin layer 4 in the electroconductive adhesive member 1 was measured to evaluate whether the resin layer 4 had an electroconductivity (0.5 Ω/□ or less), a standard level for the electromagnetic wave interceptability.

Separately, an ABS resin substrate was dipped in an etching solution of $CrO_3$—$H_2SO_4$—$H_2O$ system for one minute, washed with water and dipped in a liquid mixture composed of 30 g/l of stannous chloride and 20 ml/l of hydrochloric acid for 2 minutes. Then, the not cross-linked electroconductive adhesive member of this Example was attached to a surface-etched ABS resin substrate thus obtained as an adherend member so that the adherend member may be in contact with the resin layer 4, and then heated at 50° C. for 10 minutes to perform adhesion. The product thus obtained was used as a test piece to determine the adhesiveness of the present electroconductive adhesive member to the ABS resin substrate, thereby evaluating whether the present electroconductive adhesive member has an adhesiveness of 1 kg/cm or more.

The adhesiveness and the surface resistivity of the electroconductive adhesive members prepared in Examples 3-1 to 3-5 are shown in the following Table 3-1.

TABLE 3-1

| Example No. | Adhesiveness (kg/cm) | Surface resistivity (Ω/□) |
|---|---|---|
| 3-1 | 2–4 | 0.04 |
| 3-2 | 6–7 | 0.002 |
| 3-3 | 2–2 | 0.03 |
| 3-4 | 6–7 | 0.001 |
| 3-5 | 6–7 | 0.002 |

EXAMPLE 3-6

An outer cover 51 for a lap-top personal computer body was prepared in the same manner as in Example 2-6 except that the electroconductive adhesive member used was the same as in Example 3-4 was used.

The electromagnetic wave intercepting effect of the thus prepared outer cover was determined by transmission line procedure (ASTM ES 7.83 procedure) and it was found that very good attenuation such as about 80 dB on average was obtained in a frequency zone of 50 to 1,000 MHz.

EXAMPLE 4-1

A substrate was prepared in the following manner. That is, a copper foil substrate having a thickness of 18 μm was degreased with an alcohol solvent and then with an alkali cleaner (Pakuna No.19, trademark of a product made by Yuken Kagaku K.K.) for one minute, and washed with water, then with 10% sulfuric acid for 30 seconds, with water and finally with deionized water to activate the surface of the substrate.

An electrodeposition solution was prepared by mixing 60 parts by weight of polyester resin (Finetex ES-525, trademark of a product made by Dainippon Ink Kagaku K.K.), 40 parts by weight of polyester resin (Finetex 525, trademark of a product made by Dainippon Ink Kagaku K.K.), 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting mixture with 50 parts by weight of fine copper powder having an average particle size of 0.02 μm as electroconductive particles, then subjecting the mixture to a dispersion treatment in a ball mill for 30 hours and then the dispersion was diluted to 5% by weight with deionized water.

Electrodeposition was carried out using the substrate as an anode and a stainless steel plate as a cathode at 25° C. and pH 8.5 under an applied voltage of 100 V for 3 minutes, whereby a resin layer 4 having a thickness of 18 μm was formed on both sides of substrate to obtain an electroconductive adhesive member 1. The content of the fine copper powder in the resin layer 4 was found to be 15% by weight.

The thus obtained electroconductive adhesive member 1 was heated in an oven at 140° C. for 20 minutes to perform cross-linking. Then, the surface resistivity of the resin layer 4 in the electroconductive adhesive member 1 was measured to evaluate whether the resin layer 4 had an electroconductivity (0.5 Ω/□ or less), a standard level for the electromagnetic wave interceptability.

Separately, the copper substrate was also degreased with an alcohol solvent and then with an alkali cleaner (Pakuna No.19, trademark of a product made by Yuken Kagaku K.K.) for one minute, and then washed with 10% sulfuric acid for 30 seconds, with water and finally with deionized water to conduct a surface activation treatment.

Then, the thus prepared copper substrate was used as an adherend member and tightly placed on the electroconductive adhesive member obtained in this Example 4-1 and heated at 130° C. for 20 minutes to cross-link the resin layer 4, thereby performing adhesion. The product thus obtained was used as a test piece to determine the adhesiveness of the present electroconductive adhesive member to the copper substrate, thereby evaluating whether the present electroconductive adhesive member has an adhesiveness of 1 kg/cm or more.

EXAMPLE 4-2

A substrate prepared in the following manner was used. That is, a copper substrate 5 having a thickness of 18 μm was degreased with an alcohol solvent and then with an alkali cleaner (Pakuna No.19, trademark of a product made by Yuken Kagaku K.K.) and then washed with water, then with 10% sulfuric acid for 30 seconds, with water and finally with deionized water to conduct a surface activation treatment. Then, the substrate was treated in a liquid mixture of copper nitrate, ammonium chloride and acetic acid at 70° C. for 30 seconds to form a copper hydroxide film as a chemically colored film on the surface of copper film.

An electrodeposition solution was prepared by mixing 60 parts by weight of polyester resin (Finetax ES-525, trademark of a product made by Dainippon Ink Kagaku K.K.), 40 parts by weight of polyester resin (Finetex 525, trademark of a product made by Dainippon Ink Kagaku K.K.), 5 parts by weight of a cross-linking agent (Permastat R-5, a product made by Dainippon Ink Kagaku K.K.) and 2.5 parts by weight of a catalyst (Cat PA-20, a product made by Dainippon Ink Kagaku K.K.), then admixing the resulting mixture with 50 parts by weight of fine copper powder having an average particle size of 0.07 μm as electroconductive particles, then subjecting the mixture to a dispersion treatment in a ball mill for 30 hours and then the dispersion was diluted to 15% by weight with deionized water.

Electrodeposition was carried out using the substrate as an anode and a stainless steel plate as a cathode at 25° C. and pH 8.5 under an applied voltage of 100 V for 3 minutes, whereby a resin layer 4 having a thickness of 17 μm was formed on the copper hydroxide film surface of the substrate to obtain an electroconductive adhesive member 1. The content of the fine copper powder in the resin layer 4 was found to be 47% by weight.

The thus obtained electroconductive adhesive member 1 was heated in an oven at 140° C. for 20 minutes to perform cross-linking. Then, the surface resistivity of the resin layer 4 in the electroconductive adhesive member 1 was measured to evaluate whether the resin layer 4 had an electroconductivity (0.5 Ω/□ or less), a standard level for the electromagnetic wave interceptability.

Separately, the copper substrate was also degreased with an alcohol solvent and then with an alkali cleaner (Pakuna No.19, trademark of a product made by Yuken Kagaku K.K.) for one minute, and then washed with 10% sulfuric acid for 30 seconds, with water and finally with deionized water to activate the surface of the substrate.

Then, the thus prepared copper substrate was used as an adherend member and tightly placed on the electroconductive adhesive member obtained in this Example 4-2 and heated at 130° C. for 20 minutes to cross-link the resin layer 4, thereby performing adhesion. The product thus obtained was used as a test piece to determine the adhesiveness of the present electroconductive adhesive member to the copper substrate, thereby evaluating whether the present electroconductive adhesive member has an adhesiveness of 1 kg/cm or more.

COMPARATIVE EXAMPLE 3

A mixture composed of 100 parts by weight of an epoxy adhesive (Rixypo, trademark of a product made by Showa Kobunshi K.K.) as an electroconductive adhesive and 10 parts by weight of nickel particles having an average particle size of 0.02 μm, was sprayed onto the same substrate used in Example 4-1 to form an electroconductive adhesive layer having a thickness of 10 μm on it. After curing, the surface resistivity of the electroconductive adhesive layer of the electroconductive adhesive member was measured.

Then, the thus prepared electroconductive adhesive member was tightly placed on the same adherend member as used in Example 4-1 to cure the adhesive member, thereby performing adhesion. The product was used as a test piece to determine the adhesiveness of the electroconductive adhesive member to the adherend member of the test piece.

The adhesiveness and the surface resistivity of the electroconductive adhesive members of Example 4-1 to 4-2 and Comparative Example 3 are shown in the following Table 4-1.

TABLE 4-1

| | Adhesiveness (kg/cm) | Surface resistivity (Ω/□) |
|---|---|---|
| Example 4-1 | 2–3 | 0.05 |
| 4-2 | 2–3 | 0.005 |
| Comp. Ex. 3 | 0.5–0.8 | 0.5 |

What is claimed is:

1. An electronic equipment which comprises an outer cover, an adhesive member attached to a surface of the outer cover and a source generating electromagnetic waves, said source surrounded by the outer cover and the adhesive member to intercept said electromagnetic waves, wherein said adhesive member comprises a substrate and an adhesive resin layer containing electroconductive particles formed thereon, said electroconductive particles comprising at least one of a metal-plated ceramic powder and a metal-plated natural mica powder, said adhesive resin layer being formed on the substrate by electrodeposition coating, the substrate being a plastic substrate having a metallic thin layer on at least one side of the substrate, wherein the thin metallic layer is a copper film having a copper oxide film on a free side of the copper film not contacting with the substrate, said copper oxide film is formed prior to said electrodeposition coating as a chemically colored film by surface treatment of the copper film, and said adhesive resin layer is formed on the copper oxide.

2. An electronic equipment according to claim 1, wherein said adhesive member is attached to an inner surface of the outer cover.

3. An electronic equipment according to claim 1, wherein said ceramic powder and natural mica powder said has an average particle site of 0.1 to 5 μm.

4. An electronic equipment which comprises an outer cover, an adhesive member attached to a surface of the outer cover and a source generating electromagnetic waves, said source surrounded by the outer cover and the adhesive member to intercept said electromagnetic waves, wherein said adhesive member comprises a substrate and an adhesive resin layer containing electroconductive particles formed thereon, said electroconductive particles comprising one or two members selected from the group consisting of metal-plated resin powder and ultra fine metal powder, the substrate being a plastic substrate having a metallic thin layer on at least one side of the substrate, wherein the thin metallic layer is a copper film having a copper oxide film on a free side of the copper film not contacting with the substrate, and said adhesive resin layer is formed on the copper oxide film by electrodeposition.

5. An electronic equipment which comprises an outer cover, an adhesive member attached to a surface of the outer cover and a source generating electromagnetic waves, said source surrounded by the outer cover and an adhesive member to intercept said electromagnetic waves, wherein said adhesive member comprises a substrate and an adhesive resin layer containing electroconductive particles formed thereon, said electroconductive particles comprising at least one member selected from the group consisting of metal-plated ceramic powder, metal-plated natural mica powder and at least one member selected from the group consisting of metal-plated resin powder and ultra fine metal powder, the substrate being a plastic substrate having a metallic thin layer on at least one side of the substrate, wherein the thin metallic layer is a copper film having a copper oxide film on a free side of the copper film not contacting with the substrate, and said adhesive resin layer is formed on the copper oxide film by electrodeposition.

* * * * *

UNITED STATES PATENT AND TRADEMARK OFFICE

CERTIFICATE OF CORRECTION

PATENT NO. : 5,676,812

DATED : October 14, 1997

INVENTOR(S) : SUSUMU KADOKURA

It is certified that error appears in the above-identified patent and that said Letters Patent is hereby corrected as shown below:

COLUMN 1

Line 10, "Invention" should read --invention;
Line 21, "appliance," should read --appliances,--;
Line 43, "far" should read --bar--.

COLUMN 2

Line 5, "qlued" should read --glued--;
Line 53, "the" should be deleted.

COLUMN 4

Line 45, delete "an used".

COLUMN 5

Line 27, "metal plated" should read --metal-plated--;
Line 34, "metal plated" should read --metal-plated--;
Line 56, "nonmetallic" should read --non-metallic--;
Line 62, "copper," should read --copper--;
Line 67, "50 μm." should read --50 μm can be used.--.

COLUMN 6

Line 3, "electro-conductivity," should read --electroconductivity--;
Line 32, "member" should read --member are bonded--;
Line 40, "the cross-linking" should read --cross-linking the--.

UNITED STATES PATENT AND TRADEMARK OFFICE

CERTIFICATE OF CORRECTION

PATENT NO. : 5,676,812

DATED : October 14, 1997

INVENTOR(S) : SUSUMU KADOKURA

It is certified that error appears in the above-identified patent and that said Letters Patent is hereby corrected as shown below:

COLUMN 7

Line 49, "member. Thus" should read --member, thus--.

COLUMN 9

Line 1, "an" should read --a--;
Line 19, "Parkin-Elmer Co.)." should read --Perkin-Elmer Co.);--
Line 31, "(Finetax" should read --(Finetex--;
Line 59, "as a" should be deleted;
Line 62, "ABC" should read --ABS--.

COLUMN 10

Line 1, "Abs" should read --ABS--.

COLUMN 11

Line 32, "resin" should read --the resin--;
Line 33, "the" should be deleted;
Line 45, "degreasing" should read --degreased--;
Line 63, "electroless" should read --the electroless--.

COLUMN 12

Line 41, "electroless" should read --the electroless--;
Line 57, "the" should be deleted.

UNITED STATES PATENT AND TRADEMARK OFFICE

CERTIFICATE OF CORRECTION

PATENT NO. : 5,676,812

DATED : October 14, 1997

INVENTOR(S) : SUSUMU KADOKURA

It is certified that error appears in the above-identified patent and that said Letters Patent is hereby corrected as shown below:

COLUMN 13

Line 64, "were" should read --was--.

COLUMN 15

Line 8, "(Finetax" should read --(Finetex--;
Line 18, "0.3 μm-" should read --0.3 μm--.

COLUMN 18

Line 4, "substrate" should read --the substrate--;
Line 63, "is" should read --in--.

COLUMN 19

Line 55, "substrate" should read --the substrate--.

COLUMN 20

Line 41, "substrate" should read --the substrate--.

COLUMN 22

Line 20, "particle" should read --particles--;
Line 33, "substrate" should read --the substrate--;
Line 50, "Example" should read --Example of--;
Line 63, "was" (first occurrence) should be deleted.

UNITED STATES PATENT AND TRADEMARK OFFICE

CERTIFICATE OF CORRECTION

PATENT NO. : 5,676,812

DATED : October 14, 1997

INVENTOR(S) : SUSUMU KADOKURA

It is certified that error appears in the above-identified patent and that said Letters Patent is hereby corrected as shown below:

COLUMN 23

Line 3, "8" should read --a--;
Line 10, "(Permestat" should read --(Permastat--;
Line 37, "substrate" should read --the substrate--.

COLUMN 24

Line 17, "Example 3-4 was used." should read --Example 3-4.--;
Line 51, "substrate" should read --the substrate--.

COLUMN 25

Line 25, "(Finetax" should read --(Finetex--.

COLUMN 26

Line 57, "said" (second occurrence) should read --each--;
Line 58, "site" should read --size--.

Signed and Sealed this

Fifth Day of May, 1998

*Attest:*

*Attesting Officer*

BRUCE LEHMAN

*Commissioner of Patents and Trademarks*